US011619218B2

(12) United States Patent
Di Leo

(10) Patent No.: US 11,619,218 B2
(45) Date of Patent: Apr. 4, 2023

(54) POSITIVE DISPLACEMENT PUMP

(71) Applicant: IDEE & PRODOTTI S.R.L., Cavenago di Brianza (IT)

(72) Inventor: Vincenzo Di Leo, Cavenago di Brianza (IT)

(73) Assignee: IDEE & PRODOTTI S.R.L., Cavenago di Brianza (IT)

( * ) Notice: Subject to any disclaimer, the term of this patent is extended or adjusted under 35 U.S.C. 154(b) by 71 days.

(21) Appl. No.: 16/624,088

(22) PCT Filed: Jun. 13, 2018

(86) PCT No.: PCT/IB2018/054293
§ 371 (c)(1),
(2) Date: Dec. 18, 2019

(87) PCT Pub. No.: WO2018/234933
PCT Pub. Date: Dec. 27, 2018

(65) Prior Publication Data

US 2020/0149523 A1 May 14, 2020

(30) Foreign Application Priority Data

Jun. 19, 2017 (IT) ..... 102017000067718

(51) Int. Cl.
*F04B 43/00* (2006.01)
*F04B 53/10* (2006.01)
(Continued)

(52) U.S. Cl.
CPC ..... *F04B 43/0072* (2013.01); *F04B 43/10* (2013.01); *F04B 53/107* (2013.01);
(Continued)

(58) Field of Classification Search
CPC ..... F04B 43/0072; F04B 53/107; F04B 53/1067; F04B 43/10; F04B 53/1075;
(Continued)

(56) References Cited

U.S. PATENT DOCUMENTS 2,328,948 A * 9/1943 Bourke ..... B67D 1/0839 217/103
2,526,629 A * 10/1950 Bourke ..... B67D 1/0832 251/149.8
(Continued)

FOREIGN PATENT DOCUMENTS

GB 191508268 A 5/1916
JP 01257781 A 10/1989
(Continued)

OTHER PUBLICATIONS

India Office Action dated Jun. 28, 2021, issued in corresponding Indian application.
(Continued)

*Primary Examiner* — Kenneth J Hansen
*Assistant Examiner* — David N Brandt
(74) *Attorney, Agent, or Firm* — Husch Blackwell LLP

(57) ABSTRACT

The invention relates to a positive displacement pump (10) comprising a pump body (11, 101, 201) comprising an inlet end (16, 116, 216) and an outlet end (18, 118, 218), a pumping chamber (30, 130, 230) arranged between said inlet end (16, 116, 216) and said outlet end (18, 118, 218), at least one membrane (20, 120, 220) active in the pumping chamber (30, 130, 230) and mobile between an expanded configuration in which the volume of the pumping chamber (30, 130, 230) is maximum and a retracted configuration in which the volume of the pumping chamber (30, 130, 230) is minimum, a delivery valve (46, 146, 246) arranged close to the outlet end (18, 118, 218) of the pump body (11, 101,
(Continued)

201), an intake valve (26, 126, 226) comprising an intake mouth (27, 127, 227), an outlet mouth (28, 128, 228) and a valve wall (29, 129, 229) that joins the intake mouth (27, 127, 227) to the outlet mouth (28, 128, 228), the intake mouth (27, 127, 227) being coupled to the inlet end (16, 116, 216) of the pump body (11, 101, 201) and the outlet mouth (28, 128, 228) being inserted in the pumping chamber (30, 130, 230). Said at least one membrane (20, 120, 220), when in the retracted configuration, adheres to the valve wall (29, 129, 229) of the intake valve (26, 126, 226) and the intake valve has the outlet mouth closed.

13 Claims, 9 Drawing Sheets

(51) Int. Cl.

| | |
|---|---|
| ***F04B 43/10*** | (2006.01) |
| ***F04B 53/14*** | (2006.01) |
| ***F04B 43/08*** | (2006.01) |
| ***F04B 45/06*** | (2006.01) |

(52) U.S. Cl.
CPC ..... *F04B 53/1075* (2013.01); *F04B 43/084* (2013.01); *F04B 45/061* (2013.01); *F04B 53/14* (2013.01)

(58) Field of Classification Search
CPC ..... F04B 53/10; F04B 43/084; F04B 45/061; F04B 53/106; F04B 53/14
See application file for complete search history.

(56) References Cited

U.S. PATENT DOCUMENTS

| | | | | | |
|---|---|---|---|---|---|
| 2,772,817 | A | | 12/1956 | Jauch | |
| 2,810,347 | A | | 10/1957 | Rippingille | |
| 3,099,260 | A | * | 7/1963 | Birtwell | F04B 53/1065 600/17 |
| 3,526,223 | A | * | 9/1970 | Lee | B64G 6/00 128/202.11 |
| 4,358,252 | A | | 11/1982 | Hart | |
| 5,645,114 | A | * | 7/1997 | Bogen | B01L 3/0293 141/130 |

FOREIGN PATENT DOCUMENTS

| | | | |
|---|---|---|---|
| SU | 1078127 | A1 | 3/1984 |
| WO | 2016028259 | A1 | 2/2016 |

OTHER PUBLICATIONS

Russian Office Action dated Jun. 16, 2021, issued in corresponding Russian application.

* cited by examiner

POSITIVE DISPLACEMENT PUMP

The present invention relates to a positive displacement pump, in particular a positive displacement pump in which the change in volume in a pumping chamber causes an intake and a thrust on a fluid.

The change in volume of the pumping chamber is obtained by the reciprocating movement of a membrane, made of flexible or rigid material, which makes the pumping chamber.

The term "membrane" is meant to indicate a body that physically and functionally separates, in a fluid-tight manner, two preferably adjacent areas of the positive displacement pump. One of such two areas is the pumping chamber.

The term "flexible", when referring to the membrane, means that an elastic deformation of the membrane is functional for the correct operation of the positive displacement pump.

The term "rigid" when referring to the membrane, means that a possible elastic deformation of the membrane is not functional for the correct operation of the positive displacement pump.

The reciprocating movement of the membrane can be obtained mechanically, for example by a connecting rod-crank system to which the membrane is fixedly connected (in this case the membrane is rigid), pneumatically, for example compressing and releasing the membrane with compressed air, or hydraulically, for example by compressing and releasing the membrane with a work liquid (in this case the membrane is flexible).

The release of the membrane (interpreted as the relaxation of the membrane or translation in a first direction thereof) increases the volume of the pumping chamber creating a depression that draws liquid into the pumping chamber through the intake valve. The compression of the membrane (interpreted as tensioning of the membrane or translation in a second direction thereof) reduces the volume of the pumping chamber creating an overpressure that expels, through the delivery valve, the liquid previously taken in.

The positive displacement pumps of this type are often used for moving dense and muddy liquids, and liquids containing solid bodies, since they allow rapid dry self-priming, can operate dry for long time periods, allow the passage of solid bodies and are easy to adjust in flow rate by simply increasing the compression and release cycles of the membrane.

When the pumps are used to draw from a tank arranged at a lower height, for example a well for collecting waste water and similar, the maximum intake height of the pump, in other words the height difference between the pump and the free surface of the tank or well, can be obtained from a simple mathematical formula that, basically, requires that the maximum intake height be a direct function of the pressure that acts on the free surface of the well or tank.

Only by lowering the pressure in the pumping chamber (creating a depression) until it reaches a theoretical absolute vacuum is it possible to reach the maximum intake height (net of the load losses in the intake pipe and through the intake valve).

In the case of use of positive displacement pumps as pumps to take in dense and muddy liquids, and liquids containing solid bodies, from a well or tank arranged at a lower height (for example buried) it is thus necessary for the membrane to increase the volume of the pumping chamber so as to lower the pressure thereof on the inside and create a depression capable of drawing liquid from the well or tank.

The greater the useful expansion volume of the pumping chamber, the lower the pressure value reached in the pumping chamber and the greater the depth from which liquid can be taken in.

The Applicant has noted that when the membrane of the positive displacement pumps is in the configuration of minimum volume of the pumping chamber, the residual volume (or dead volume) of the pumping chamber is not zero and indeed has a non-negligible value.

The Applicant has noted that such a residual volume has a substantial impact on the minimum pressure level, in other words the depression, which can be reached inside the pumping chamber.

In particular, for the same maximum volume of the pumping chamber, the greater the residual volume (dead volume), the greater the minimum pressure (in other words the lower the depression) that can be obtained inside the pumping chamber.

Indeed, the final pressure inside the pumping chamber is to a first approximation given by the initial pressure in the pumping chamber (substantially always constant) multiplied by the ratio between the initial volume (the residual or dead volume) and the final maximum volume of the pumping chamber.

The Applicant has realized that it would be advantageous to be able to have positive displacement pumps for dense and muddy liquids, and also liquids containing solid bodies that are capable of drawing from heights as close as possible to the maximum intake heights.

The Applicant has however realized that it is not possible to increase the maximum volume of the pumping chamber beyond a certain limit, both for reasons of space occupied by the pump and for reasons linked to the elasticity of the membrane (when the latter is made of flexible material).

The present invention therefore relates to a positive displacement pump comprising:

a pump body comprising an inlet end and an outlet end;

a pumping chamber arranged between said inlet end and said outlet end;

at least one membrane active in the pumping chamber and mobile between an expanded configuration in which the volume of the pumping chamber is maximum and a retracted configuration in which the volume of the pumping chamber is minimum;

a delivery valve arranged close to the outlet end of the pump body, an intake valve comprising an intake mouth, an outlet mouth and a valve wall that joins the intake mouth to the outlet mouth, the intake mouth being coupled to the inlet end of the pump body and the outlet mouth being inserted in the pumping chamber, in which said at least one membrane, when in the retracted configuration, adheres to the valve wall of the intake valve and the intake valve has the outlet mouth closed.

The passage from the retracted configuration to the expanded configuration of the at least one membrane determines an increase in the volume of the pumping chamber that takes place with the intake valve and the delivery valve closed.

This causes a decrease in the pressure inside the pumping chamber that opens the intake valve and allows intake from an intake duct.

The Applicant has realized that by coupling the intake mouth of the intake valve to the inlet end of the pump body, inserting the outlet mouth inside the pumping chamber and arranging the membrane, when in the retracted configuration, so that it adheres to the valve wall, the volume of the pumping chamber at the inlet of the pump body (when the membrane is in the retracted configuration) is practically zero or in any case very low.

In this way, the dead volume of the pumping chamber at the inlet of the pump body is negligible, ensuring very low minimum pressures inside the pumping chamber when the membrane is in the expanded configuration.

This makes it possible to obtain intake heights that can approach the theoretical maximum intake height.

The term "adhere" is used in the present description and in the following claims to indicate a direct contact between the membrane and the valve wall of the intake valve. Such contact is preferably such that the profile of the membrane follows the profile of the valve wall of the intake valve (when the outlet mouth is closed) substantially copying the shape thereof.

The positive displacement pump according to the present invention can comprise one or more of the following characteristics considered singularly or in combination with each other.

Preferably, when said membrane is in the expanded configuration, the outlet mouth of the intake valve is open and the membrane does not contact the intake valve.

In this way the membrane does not interfere with the intake valve during the intake step of the pump, allowing it to open completely and to carry out its function.

Preferably, a first clamping device is active on the outlet mouth of the intake valve and inserted in said pumping chamber to close said outlet mouth fluid-tight when the membrane is in the retracted configuration.

The first clamping device has the function of aiding the closure of the intake valve and, particularly, of suddenly triggering the closure of the intake valve when the membrane starts to contract at the end of the expansion step.

Preferably, the first clamping device comprises a pair of opposite pressing members active at the outlet mouth of the intake valve, said pressing members being rotatably and elastically coupled to the inlet end of the pump body to move between a close-together position in which they close the outlet mouth of the intake valve and a separated condition in which they leave the outlet mouth of the intake valve open.

In this way, the pressing members exert a compression action on the outlet mouth of the intake valve that ensures the perfect closure thereof.

The compression action exerted by the pressing members is calculated in advance so that they do not obstruct the opening of the outlet mouth of the intake valve when the membrane passes from the retracted configuration to the expanded configuration, allowing a correct operation of the valve itself.

The compression action of the pressing members is preferably carried out by elastic members that rotatably couple the pressing members to the inlet end of the pump body.

In a first preferred embodiment of the invention, said at least one membrane is a substantially tubular membrane the inner volume of which defines the pumping chamber, coupled to the inlet end and to the outlet end of the pump body and deformable between the expanded configuration and the retracted configuration.

In this embodiment, there is only one membrane and it is made of flexible material, so as to be able to be switched between the expanded and retracted configuration.

Preferably, said membrane comprises a connection appendage having a first edge that extends from an outer surface of the membrane and a second free edge coupled in a fluid-tight manner to the outlet end of the pump body.

Preferably, said delivery valve is defined by a free end portion of the membrane that extends beyond the first edge of the connection appendage towards the outlet end of the pump body.

The connection appendage, performing the function of sealed connection with the outlet end of the pump body, makes it possible to arrange the end portion of the membrane so that it is free, in other words not connected to the pump body.

In this way, the delivery valve is made directly by the end portion of the membrane that, being free, can freely expand discharging what is introduced in the pumping chamber through the intake valve and can contract so as to collapse on itself, closing the delivery.

The dead volume at the delivery valve is also reduced to the point of almost reaching zero, since the portion of pumping chamber made by the end portion of the membrane is practically zero when the membrane is in the retracted configuration.

Preferably, said pump body comprises a work opening in fluid communication with a work fluid source and in which the inner volume of said membrane is insulated from said work fluid; between said membrane and said pump body a work volume is defined that is arranged to be filled and at least partially emptied of said work fluid.

In this way, the membrane expands and contracts under the action exerted by the work fluid that is introduced into, and discharged from, the work volume.

The expansion of the membrane causes the opening of the intake valve (with the delivery valve closed) due to the depression (in other words the pressure decrease) made in the pumping chamber.

The depression in the pumping chamber tends to make the free end portion of the membrane collapse in an ever more accentuated manner, ensuring the closure of the delivery valve during the expansion of the membrane.

Preferably, a second clamping device is active on the outlet free end portion of the membrane to close the free end portion in a fluid-tight manner when the membrane is in the retracted configuration.

The second clamping device has the function of assisting the closure of the delivery valve compressing the free end portion of the membrane.

The second closure device also has the function of suddenly triggering the closure of the delivery valve when the membrane starts to expand at the end of the retraction step.

Preferably, said second clamping device comprises a pair of opposite pressing members active on the free end portion of the membrane, said pressing members being rotatably and elastically coupled to the outlet end of the pump body to move between a close-together position in which they close the free end portion of the membrane and a separated condition in which they leave the free end portion of the membrane open.

In this way, the pressing members exert a compression action on the free end portion of the membrane that ensures the perfect closure thereof.

The compression action exerted by the pressing members is calculated in advance so that they do not obstruct the opening of the delivery valve when the membrane passes from the expanded configuration to the retracted configuration, allowing correct operation of the delivery valve.

The compression action of the pressing members is preferably carried out by elastic members that rotatably couple the pressing members to the outlet end of the pump body.

In a second embodiment of the invention, preferably there are two membranes that are rigid and opposite.

Preferably, the two membranes delimit said pumping chamber and each membrane comprises an end portion countershaped to the shape of the valve wall of the intake chamber when the outlet mouth of the intake valve is closed.

Preferably, each membrane is made mobile between the expanded configuration and the retracted configuration by electromechanical or hydraulic actuator members.

The actuator members preferably act directly on the two membranes moving them together and apart from one another.

In a third embodiment, preferably there are two membranes and they are made of flexible material.

The two membranes preferably delimit said pumping chamber and each membrane is coupled to the inlet end and to the outlet end of the pump body and is deformable between the expanded configuration and the retracted configuration.

Preferably, a pair of work chambers contains a work fluid insulated from the pumping chamber by said membranes, on said work fluid actuator members being active to transmit a pressure to said membranes and switch them from the retracted configuration to the expanded configuration and vice-versa.

Each work chamber is preferably arranged between an actuator and a flexible membrane, so that a translation of the actuator corresponds to a change in pressure of the work fluid (arranged between the membrane and the actuator) which determines a deformation of the flexible membrane.

Preferably, in all of the preferred embodiments of the invention, said intake valve is a duckbill valve.

In this way, the valve cannot be clogged very easily by solid bodies or by muddy sludge and also closes and opens under the action of differential pressures between the inlet and the outlet of the valve itself and it is one-way.

Further characteristics and advantages of the invention will become clearer from the description of some preferred embodiments, made with reference to the attached drawings, in which.

Figure 1:
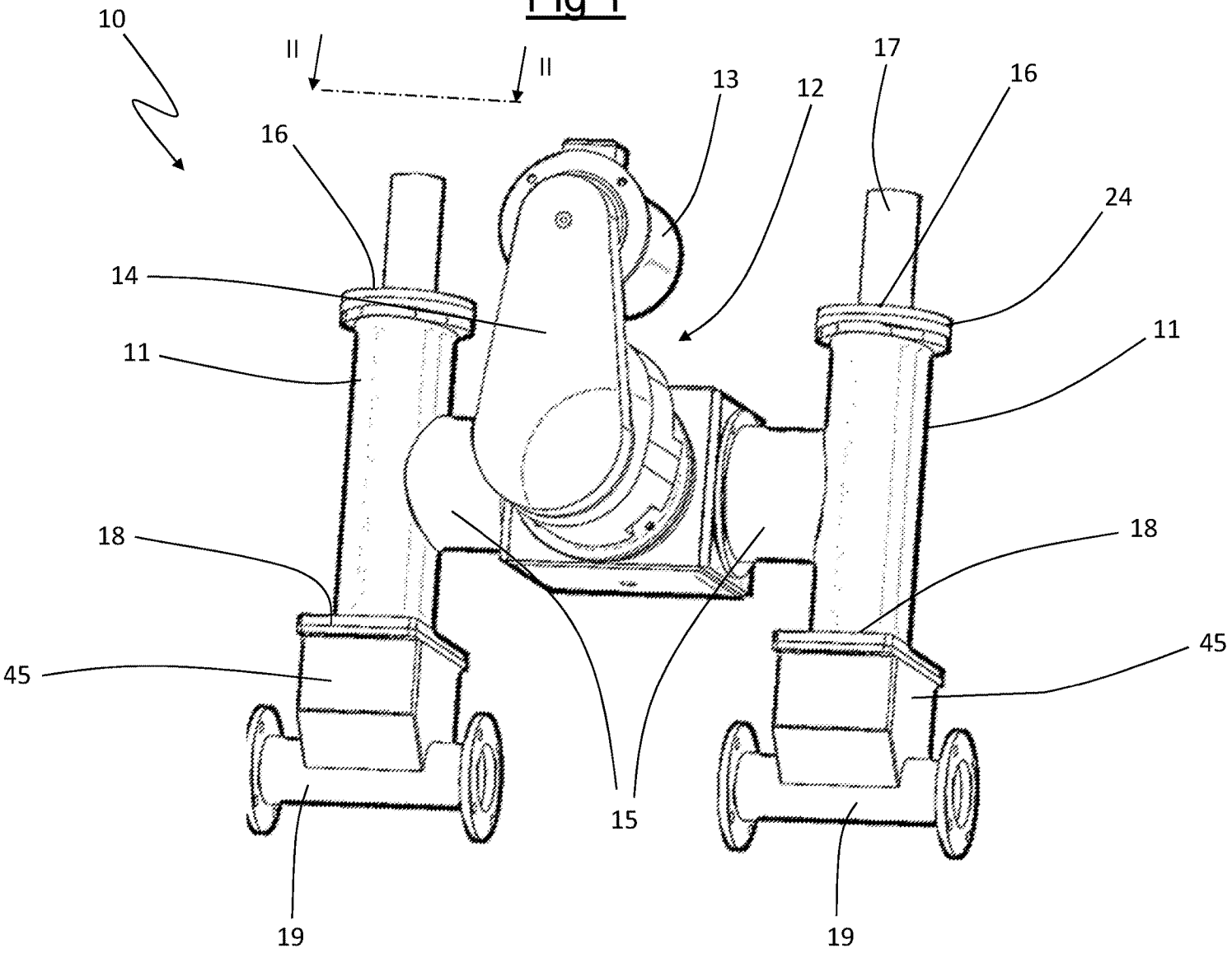
FIG. 1 is a schematic perspective view of a first embodiment of a positive displacement pump in accordance with the present invention.

With reference to the attached figures, reference numeral 10 wholly indicates a positive displacement pump according to the present invention.

In accordance with a first embodiment of the pump 10 illustrated in FIGS. 1 to 6, the positive displacement pump 10 comprises a pair of pump bodies 11 arranged parallel to one another. However, it is possible to provide for only one pump body 11, as will be clear hereinafter.

An actuator 12 which has the function of inserting and removing a work fluid from the pump body 11 acts on each pump body 11.

The actuator 12 can for example be an electric motor 13 on the drive shaft of which a pinion is fitted, on which a chain or a transmission belt is engaged (not illustrated), preferably contained in a casing 14. The chain or transmission belt is also fitted onto a toothed crown (not illustrated) that actuates a linkage, for example of the connecting rod-crank type, which places a piston in reciprocating rectilinear motion (not illustrated). The piston slides inside a cylinder 15 so as to act on a work fluid.

In the embodiment illustrated in FIG. 1, two opposite cylinders are provided in which a single piston or, preferably, two opposite pistons act, moved by the same actuator 12.

The cylinder 15 is in fluid communication, through a work opening 11*a*, with the pump body 11 so as to introduce work fluid into the pump body 11 during a compression stroke and to take work fluid from it during a return stroke.

Alternatively, the work fluid can be introduced and taken from the pump body 11 by another other device actuated electrically, manually or with a thermal engine.

Each pump body 11 has a substantially cylindrical shape and is placed in fluid communication, at an inlet end 16, with an intake duct 17 and, at an outlet end 18, with one or more delivery ducts 19.

The work fluid is preferably a liquid like for example oil or water.

Figure 2:
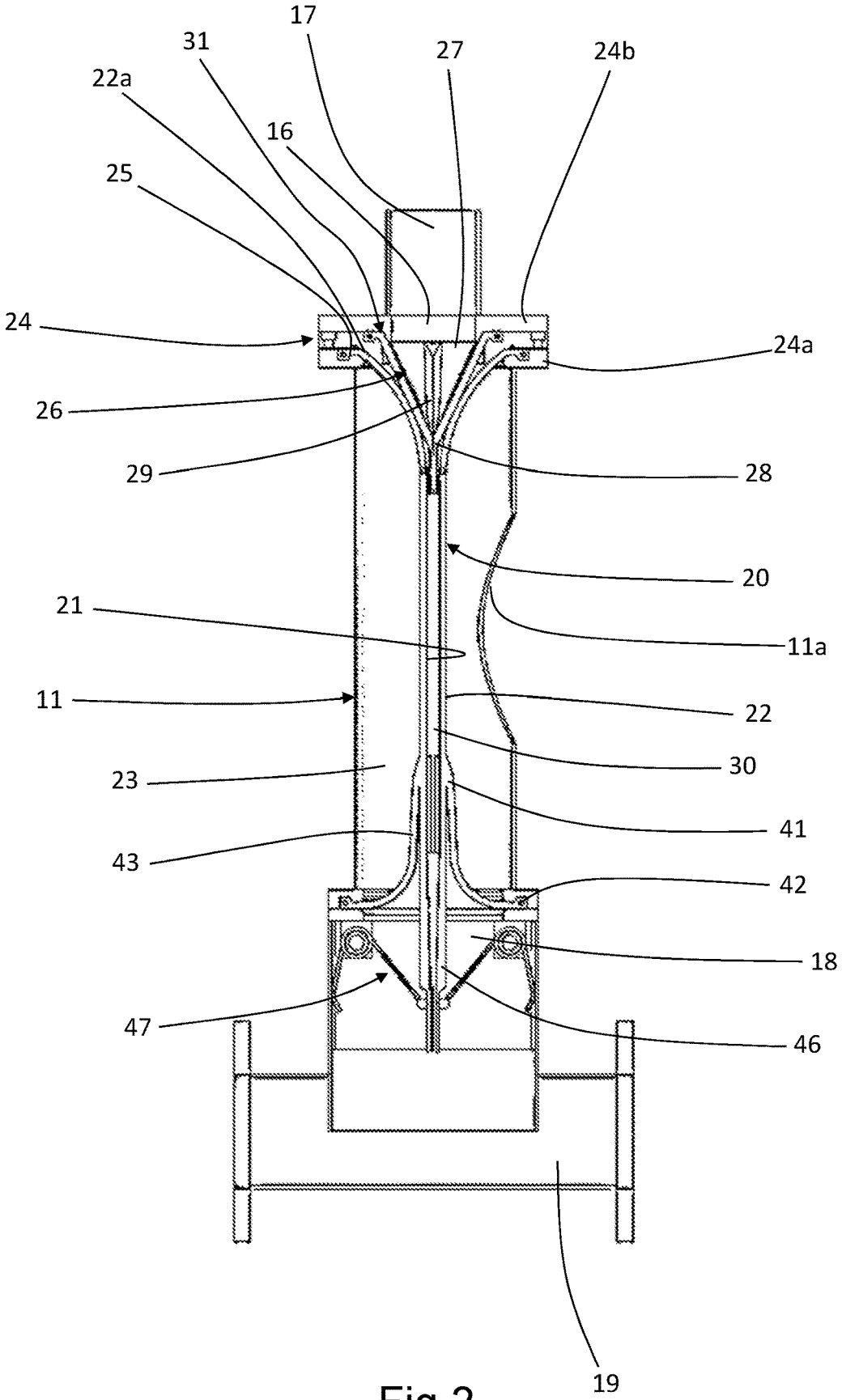
FIG. 2 is a section view along the plane II-II of the positive displacement pump of FIG. 1 in a first operative configuration.

As better illustrated in FIG. 2, a membrane 20 made of flexible material, like for example natural rubber or any other material with similar properties, is inserted in each pump body 11.

The membrane 20 has a substantially tubular shape and has an inner wall 21 and an outer wall 22.

The inner wall 21 of the membrane 20 encloses and defines a pumping chamber 30.

The membrane 20 is connected in a fluid-tight manner to the inlet end 16 and to the outlet end 18 of the pump body 11 so that a work volume 23 is made that surrounds the membrane 20 between the outer wall 22 of the membrane and the pump body 11.

The work volume 23 is in fluid communication with the work opening 11*a* of the pump body 11 so as to be able to be filled and at least partially emptied of the work fluid.

In particular, when the work liquid is introduced in the work volume 23, a pressure is exerted on the outer wall 22 of the membrane 20 that causes the contraction of the membrane 20 in a retracted configuration, as illustrated in FIG. 2.

The pressure exerted by the work fluid on the membrane 20 is substantially evenly distributed along the entire outer wall 22 of the membrane 20.

Figure 3:
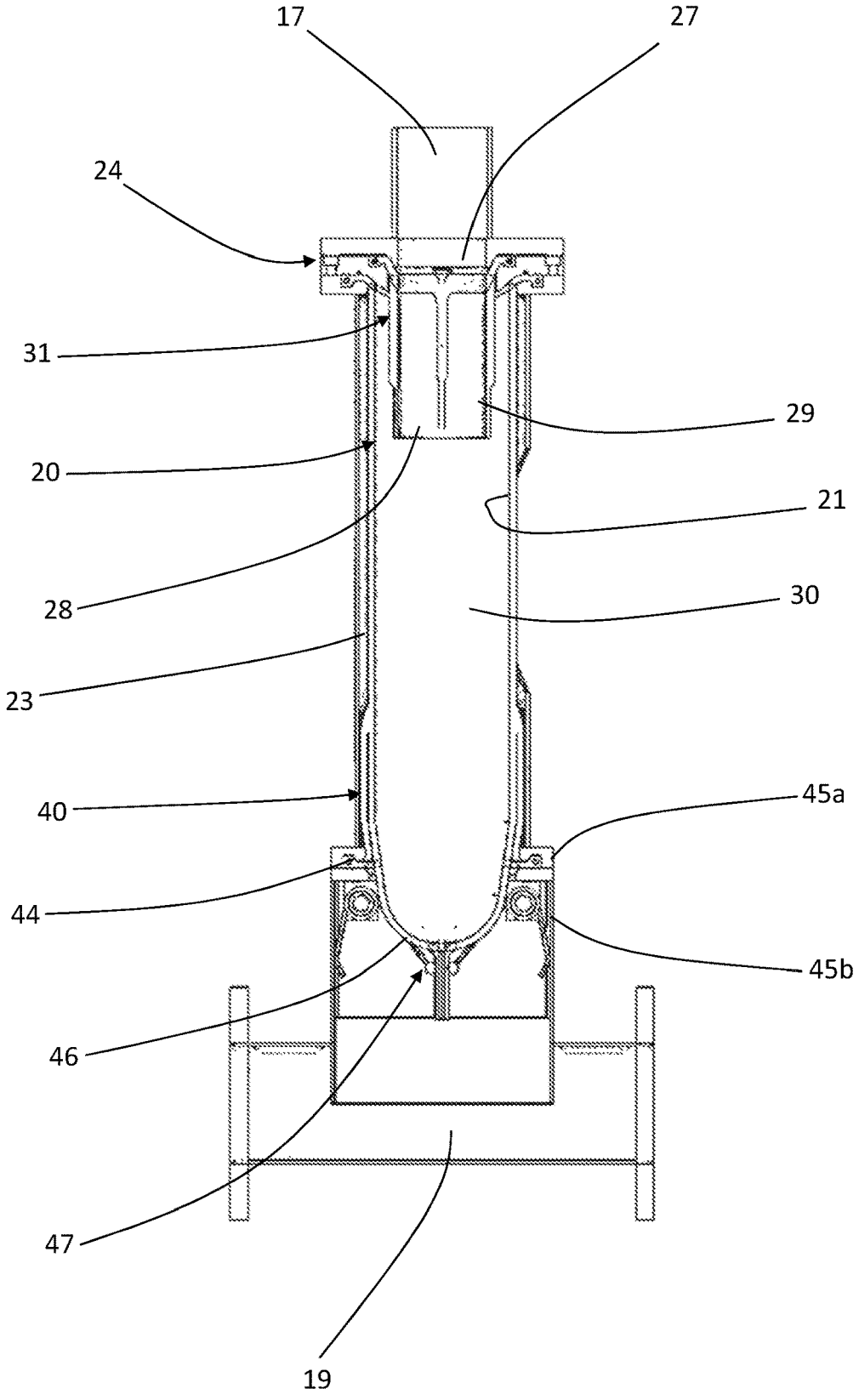
FIG. 3 is a section view along the plane II-II of the positive displacement pump of FIG. 1 in a second operative configuration.

When the work liquid is extracted from the work volume 23, the membrane 20 expands, as illustrated in FIG. 3.

The pump body 11 comprises, at the inlet end 16, an annular connection flange 24 with the intake duct 17.

The annular flange 24 comprises a first half-part 24*a* and a second half-part 24*b* facing and connected to one another.

The first half-part 24*a* is fixedly connected to the pump body 11 and the second half-part 24*b* is fixedly connected to the intake duct 17.

Between the first 24*a* and the second half-part 24*b* of the flange 24 a substantially annular housing seat 25 is formed in which a free edge 22*a* of the membrane 20 is housed, as illustrated in FIG. 2.

The coupling between the membrane 20 and the flange 24 defines the maximum passage area of the membrane 20 itself.

The flange 24 has a central through opening inside which a one-way intake valve 26 is inserted and connected.

The intake valve 26 comprises an intake mouth 27, an outlet mouth 28 and a valve wall 29 that joins the intake mouth 27 to the outlet mouth 28.

The intake valve 26 is a duckbill valve, in other words it comprises an intake mouth 27 having an undeformable cylindrical shape and an outlet mouth 28 that deforms passing from the closed configuration to the open configuration.

The outlet mouth 28, when in the closed configuration, has a substantially one-dimensional shape, in other words it is defined by a (closed) linear slit and, when in the open configuration, assumes a circular shape.

The valve wall 29 joins the intake mouth 27 and the outlet mouth 28 deforming to allow the outlet mouth 28 to change shape in passing from the closed configuration to the open configuration.

The valve wall 29 therefore changes shape in passing from the closed configuration to the open configuration (and vice-versa) of the intake valve 26.

When the pressure downstream of the intake valve 26 is greater than that upstream, a distributed force is exerted on the valve wall 29 that deforms it making the outlet mouth 28 assume the configuration with a (closed) linear slit, closing the intake valve 26.

When the pressure downstream of the intake valve 26 is less than that upstream, a distributed force is exerted on the valve wall 29 that deforms it making the outlet mouth 28 assume the circular configuration, opening the intake valve 26.

As illustrated in FIG. 2, the intake valve 26 is at least partially, preferably completely, inserted in the pumping chamber 30. The valve wall 29 of the intake valve 26 is at least partially inserted, preferably completely inserted, in the pumping chamber 30. In particular, the valve wall 29 of the intake valve 26 is at least partially inserted, preferably completely inserted, inside the membrane 20. As can be appreciated from FIG. 2, the intake valve 26 is inserted inside the membrane 20.

When the membrane 20 is in the retracted configuration (FIG. 2), the inner wall 21 of the membrane is in close contact with the valve wall 29, in other words with the portion of valve wall 29 inserted in the pumping chamber 30, in other words it rests at the valve wall 29 matching the shape thereof.

The volume between the membrane 20 and the valve wall 29 tends to be zero when the membrane 20 is in the retracted configuration.

When the membrane 20 is in the expanded configuration (as illustrated in FIG. 3), the inner wall 21 of the membrane is spaced from the valve wall 29, allowing perfect opening thereof.

For this purpose, the coupling area between the membrane 20 and the pump body 11 is arranged more externally (more towards the outside of the pump body 11) with respect to the coupling area between the intake valve 26 and the pump body 11.

A first clamping device 31 which has the function of ensuring a perfect closure of the outlet mouth 28 when the membrane 20 is in the retracted configuration and also of triggering the closure of the outlet mouth 28 when the membrane 20 starts to pass from the expanded configuration to the retracted configuration (for reasons that will become clear hereinafter), is active on the outlet mouth 28 of the intake valve 26.

The first clamping device 31 is arranged between the inner surface 21 of the membrane 20 and the valve wall 29 of the intake valve 26.

Figure 5:
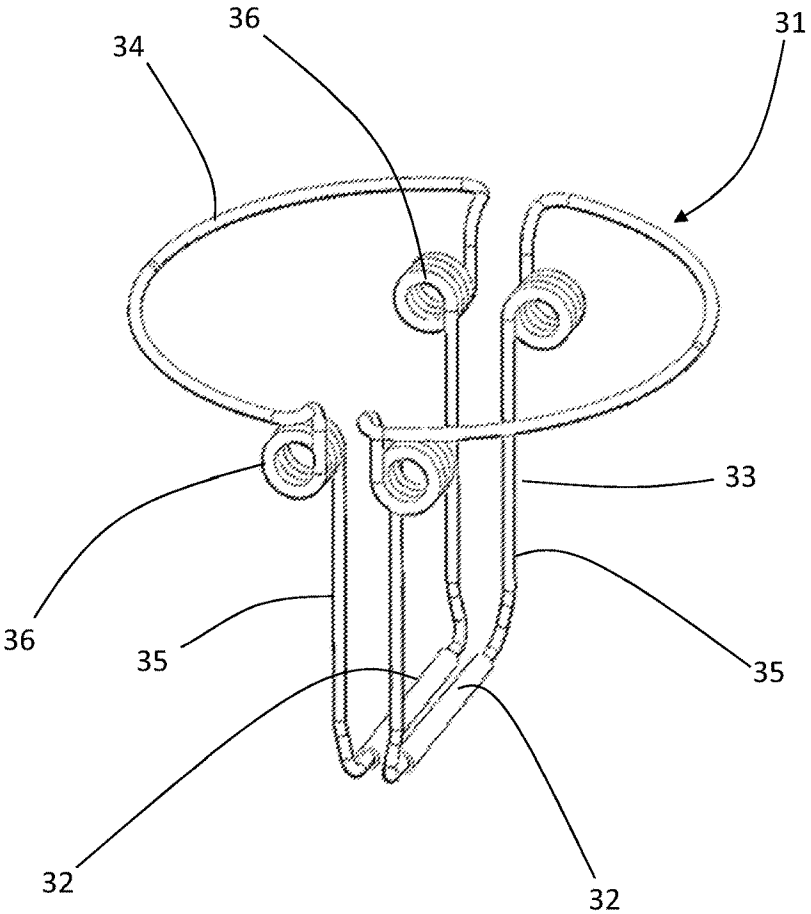

As illustrated more clearly in FIG. 5, the first clamping device 31 comprises a pair of pressing members 32 which are configured to contact the valve wall 29 close to the outlet mouth 28.

The pressing members 32 are preferably made from a pair of rods and have a substantially rectilinear extension and are parallel to one another so as to be able to act on opposite sides of the valve wall 29 close to the outlet mouth 28.

It should be noted that the valve wall 29, close to the outlet mouth 28 has an almost one-dimensional shape when the outlet mouth is in the closed configuration, in other words it has two substantially flat opposite walls close to one another.

The pressing members 32 are supported by an anchoring structure 33 which is coupled to the inlet end 16 of the pump body 11.

The anchoring structure 33 supports the pressing members 32 rotatably and elastically, so as to allow the latter to move between a close-together position in which they act on the outlet mouth 28 of the intake valve 26 (as illustrated in FIG. 2) and a separated position in which they do not interfere with the intake valve 26 (as illustrated in FIG. 3).

The anchoring structure 33 comprises an annular body 34 (FIG. 5) housed in a seat of the flange 24. The annular body 34 has a transversal dimension, in other words an inner diameter, greater than the transversal dimension of the intake mouth 27 of the intake valve 26, so that the intake mouth 27 is inserted in the annular body 34.

As illustrated in FIG. 5, the anchoring structure 33 also comprises a pair of U-shaped support elements 35 that extend from the annular body 34. The support elements 35 are rotatable with respect to the annular body 34 in opposition to respective pairs of springs 36. The rotation of the support elements 35 with respect to the annular body 34 takes place in opposite directions and along rotation axes substantially parallel to one another and parallel to the linear slit defined by the outlet mouth 27 of the intake valve 26 when in closed configuration.

The support elements 35, the springs 36 and the annular body 32 are preferably made in one piece, but alternatively they can be made from distinct pieces connected to one another.

The pressing members 32 are fixedly connected to the support elements 35 so as to be arranged parallel to the rotation axes thereof, in other words parallel to the linear slit defined by the outlet mouth 27 of the intake valve 26 when in closed configuration.

As stated above, the membrane 20 is connected in a fluid-tight manner to the outlet end 18 of the pump body 11.

Concerning this, the membrane comprises a connection appendage 40 having a substantially frusto-conical shape equipped with a first edge 41 and a second edge 42 joined by a side wall 43 (FIG. 2).

The first edge 41 is connected to, preferably is in one piece with, the outer surface 22 of the membrane 20 in a position preferably close to the outlet end 18 of the pump body 11.

The second edge 42 is a free edge and is inserted in a seat 44 of a flange 45 that connects the outlet end 18 of the pump body 11 to the delivery duct 19 (FIG. 3).

The flange 45 is annular and comprises a first half-part 45*a* and a second half-part 45*b* facing and connected to one another.

The first half-part 45*a* is fixedly connected to the pump body 11 and the second half-part 45*b* is fixedly connected to the delivery duct 19.

Between the first 45*a* and the second half-part 45*b* the substantially annular seat 44 is formed in which the free edge 44 of the connection appendage 40 is housed, as illustrated in FIG. 3.

The flange 45 has a central through opening inside which a free end portion 46 of the membrane 20 is inserted.

The central through opening of the flange 45 is not in fluid communication with the work volume 23 and is insulated from the latter by the connection appendage 40.

The free end portion 46 of the membrane 20 makes a delivery valve the operation of which will be described hereinafter.

The free end portion 46 of the membrane 20 has, on the inner surface 21 of the membrane 20, a plurality of annular or spiral-shaped projections (not illustrated) which behave like a plurality of sealing gaskets when the delivery valve is closed.

A second clamping device 47 which has the function of ensuring perfect closure of the delivery valve and also of triggering the closure thereof is active on the free end portion 46 of the membrane 20.

The second clamping device 47 is arranged outside of the membrane 20. As illustrated in the attached figures, the second clamping device 47 is arranged downstream of the through opening of the flange 45 and before the delivery duct 19. In particular, the second clamping device 47 is arranged in the second half-part 45*b* of the flange 45.

Figure 6:
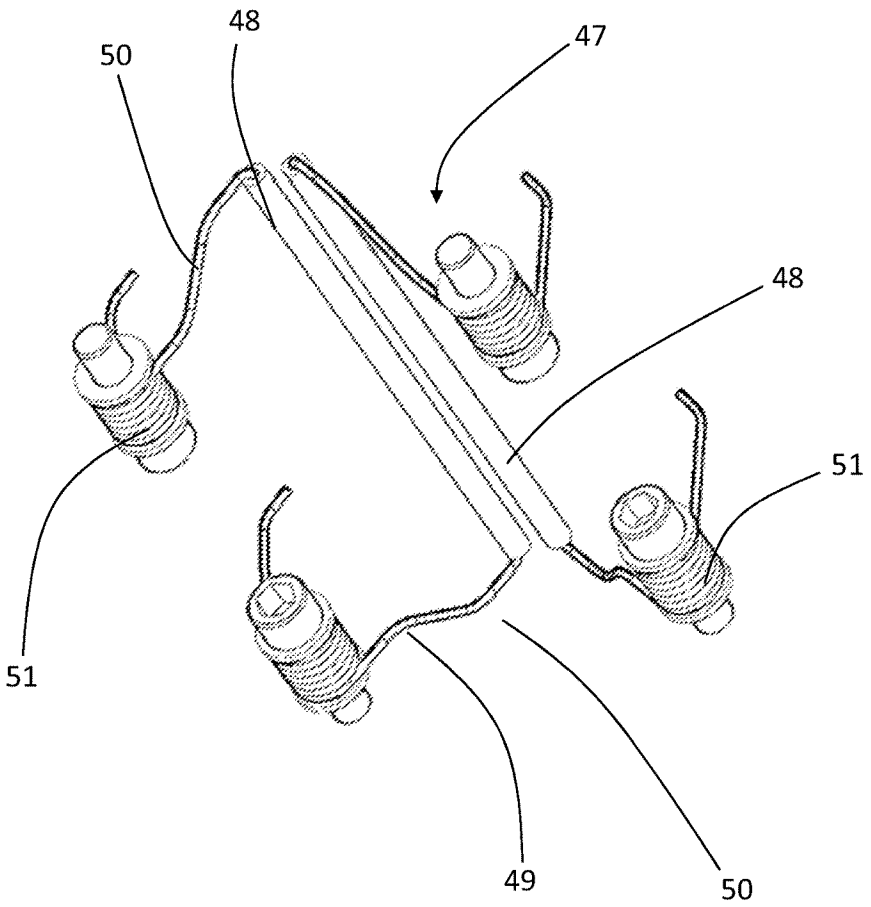
FIGS. 5 and 6 are schematic perspective views of some details of the positive displacement pump of FIG. 1.

As better illustrated in FIG. 6, the second clamping device comprises a pair of pressing members 48 which are configured to contact the outer surface 22 of the membrane 20 at the free end portion 46.

The pressing members 48 are preferably made from a pair of rods and have a substantially rectilinear extension and are parallel to one another so as to be able to act on opposite sides of the free end portion 46 of the membrane 20.

The pressing members 48 are supported by a support structure 49 which is coupled at the outlet end 18 of the pump body 11. More in particular, the support structure 49 is coupled inside the second half-part 45*b* of the flange 45.

Figure 4:
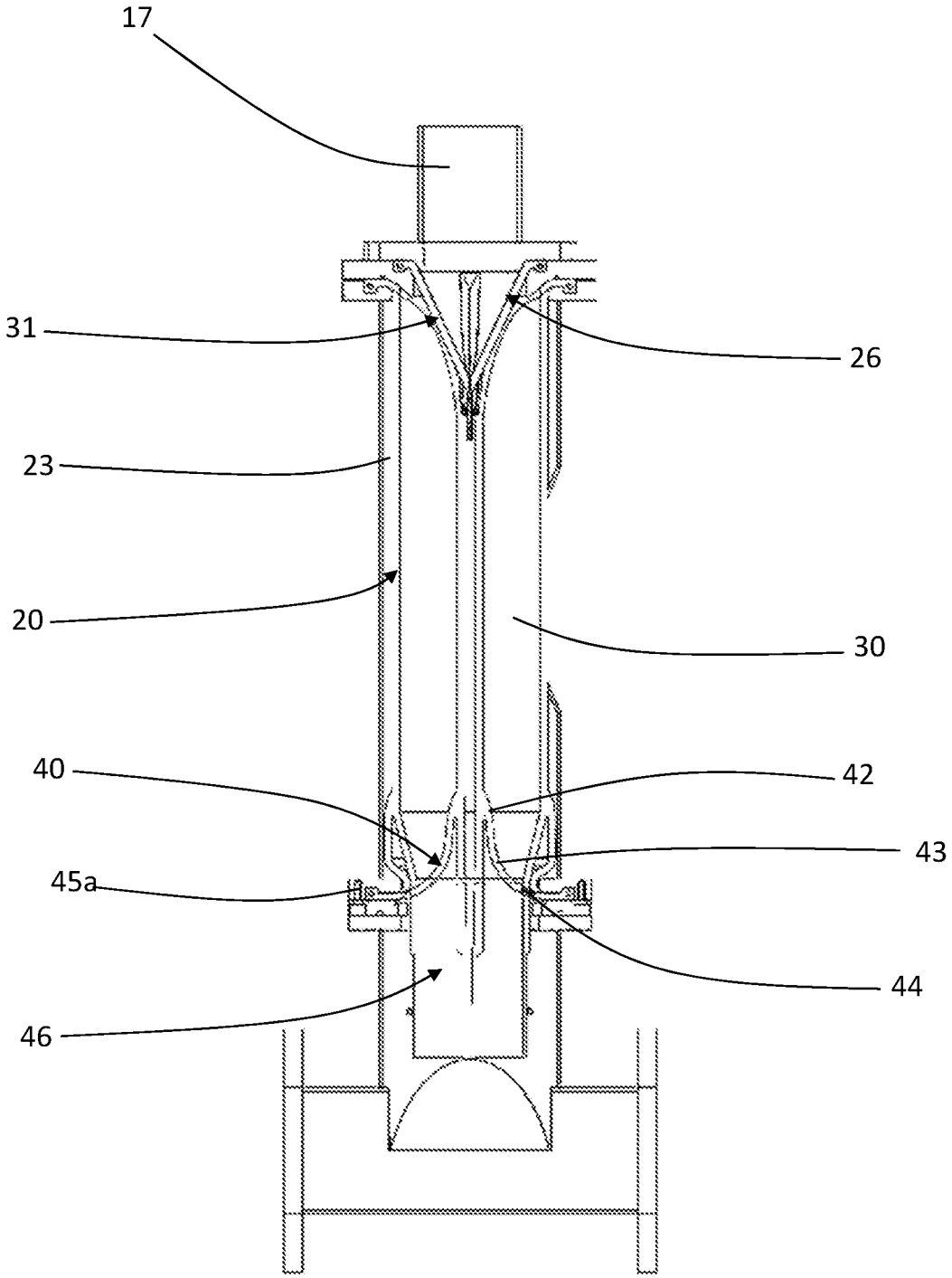
FIG. 4 is a section view along the plane II-II of the positive displacement pump of FIG. 1 in a third operative configuration.

The support structure 49 supports the pressing members 48 rotatably and elastically, so as to allow the latter to move between a close-together position in which they act on the free end portion 46 of the membrane 20 (as illustrated in FIGS. 2 and 3) and a separated position in which they allow the free end portion 46 to expand (as illustrated in FIG. 4).

The support structure 49 comprises a pair of U-shaped support arms 50 coupled to the second half-part 45*b* of the flange 45 in a yielding manner. In particular, the support arms 50 are rotatable with respect to the flange 45 in opposition to respective pairs of springs 51. The rotation of the support arms 50 with respect to the flange 45 takes place in opposite directions and along rotation axes substantially parallel to one another and parallel to the pressing members 48.

The pressing members 48 are preferably arranged at a greater height, in other words closer to the inlet end 16, with respect to the pair of springs 51. It should be noted that in FIGS. 2 and 3, the pressing members have been represented at a lower height with respect to the springs 51.

The support arms 50 and the springs 51 are preferably made in one piece, or alternatively they can be made from distinct pieces connected together.

The pressing members 48 are fixedly connected to the support arms 50 so as to be arranged parallel to the rotation axes thereof.

Alternatively, the pressing members 48 can be of the type already described in relation to the pressing members 32 of the first clamping device 31.

When the positive displacement pump 10 starts, the membrane 20 is in the retracted configuration and the work volume 23 is filled with work fluid.

In this configuration, the intake valve 26 is closed since a force acts on the valve wall 29 thereof that is generated by the pressure difference between the intake duct 17 and the work chamber 23 that is directed from the outer surface 22 of the membrane 20 to the inner surface 21 thereof (since the pressure in the work chamber is greater than the pressure in the intake duct).

The membrane 20 contacts the valve surface 29 so that the dead volume between membrane 20 and intake valve 26 is zero or in any case very low.

In this configuration, the pressing members 32 of the first clamping device 31 assist the valve surface 29 in holding the outlet mouth 28 of the intake valve 26 in closed position.

The delivery valve is also closed, since the pressure inside the pumping chamber 30 is substantially equal to the pressure in the delivery duct 19 and the membrane 20 is in retracted configuration.

The free end portion 46 of the membrane 20 (which defines the delivery valve) therefore remains in collapsed position, actually closing the pumping chamber 30 (in other words the inside of the membrane 20) fluid-tight.

The annular projections present inside the membrane 20 at the free end portion 46 act as gaskets increasing the degree of fluid-tight seal of the delivery valve.

Moreover, the pressing members 48 of the second clamping device 47 press against the outer surface 22 of the membrane 20 at the free end portion 46 further increasing the degree of fluid-tight seal of the delivery valve.

In this condition, the total volume of the pumping chamber 30 (which defines the dead volume) is very low, theoretically tending to zero, since the entire membrane 20 is collapsed on itself and against the valve wall 28 of the intake valve 26

This initial configuration is illustrated in FIG. 2.

When the work fluid is extracted from the work volume 23, the membrane 20 expands decreasing the pressure inside the pumping chamber 30.

The pressure decrease inside the pumping chamber 30 is inversely proportional to the dead volume of the pumping chamber (the smaller the dead volume, the greater the pressure decrease), and therefore, since such a dead volume is very limited (due to what was stated above), the pressure decrease inside the pumping chamber 30 is substantial.

This makes it possible to obtain an excellent head of the positive displacement pump 10, in other words an ability to draw liquid from lower heights close to the maximum lower height theoretically reachable.

The pressure decrease inside the pumping chamber 30 determines the opening of the intake valve 26. Indeed, a force acts on the valve wall 29 of the intake valve 26 that is generated by the pressure difference between the intake duct 17 and the pumping chamber 30 that is directed from the outer surface 22 of the membrane 20 to the inner surface 21 thereof (since the pressure in the pumping chamber 30 is less than the pressure in the intake duct).

The pressing members 32 of the first clamping device 31 move apart under the thrust of the valve wall 29 of the intake valve 26 allowing the complete opening of the intake valve 26.

The delivery valve is still closed since the pressure inside the pumping chamber 30 is less than the pressure in the delivery duct 19.

The free end portion 46 of the membrane 20 (which defines the delivery valve) therefore remains in collapsed position, closing the pumping chamber 30 fluid-tight.

The depression (pressure decrease) inside the pumping chamber 30 draws fluid from the intake duct 17 and the intake valve 26 allows the passage of muddy liquids and even liquids containing solids towards the pumping chamber 30.

This configuration is illustrated in FIG. 3.

When the pumping chamber 30 (the membrane 20) is completely expanded, it is filled with liquid sucked by the intake duct 17 and work fluid is pumped into the work volume 23.

The membrane 20 starts to contract under the effect of the greater pressure on its outer surface 22 actuated by the work fluid.

At this point the intake valve 26 starts to close since a force transmitted by the membrane 20 acts on the valve wall 29 thereof.

The membrane 20 indeed starts to contact the valve surface 29 under the action of the work fluid.

The pressing members 32 of the first clamping device 31 also act on the valve surface 29 tending to close the outlet mouth 28 of the intake valve 26.

In a few moments the intake valve 26 (given its duckbill shape) closes completely.

At the same time, the delivery valve opens, since the liquid contained in the pumping chamber 30, under the effect of the thrust of the membrane 20 (caused by the work fluid), expands the free end portion 46 of the membrane 20 (which is not subjected to the action of the work fluid) overcoming the resistance offered by the pressing members 48 of the second clamping device 47.

This configuration is shown in FIG. 4.

The liquid sucked is then sent in the delivery duct 19 until the membrane 20 reaches the retracted configuration again, in which the delivery valve also closes due to the complete collapse on itself of the membrane 20 (and of the free end portion 46 thereof) and of the pressing members 48 of the second clamping device 47.

The cycle described above starts again and repeats as long as the actuator 12 is in operation.

Figure 7:
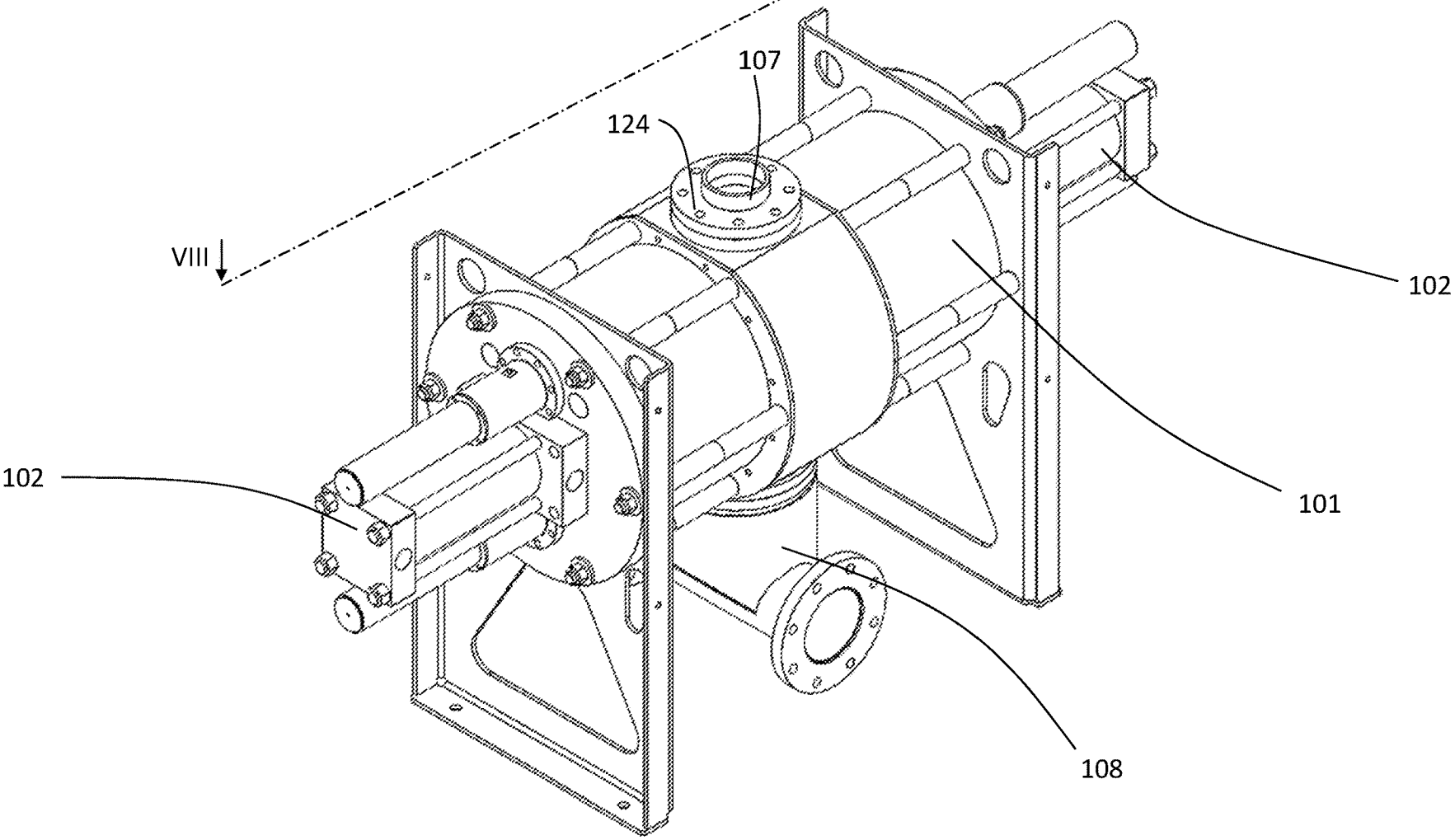
FIG. 7 is a schematic perspective view of a further embodiment of a positive displacement pump in accordance with the present invention.
Figure 8:
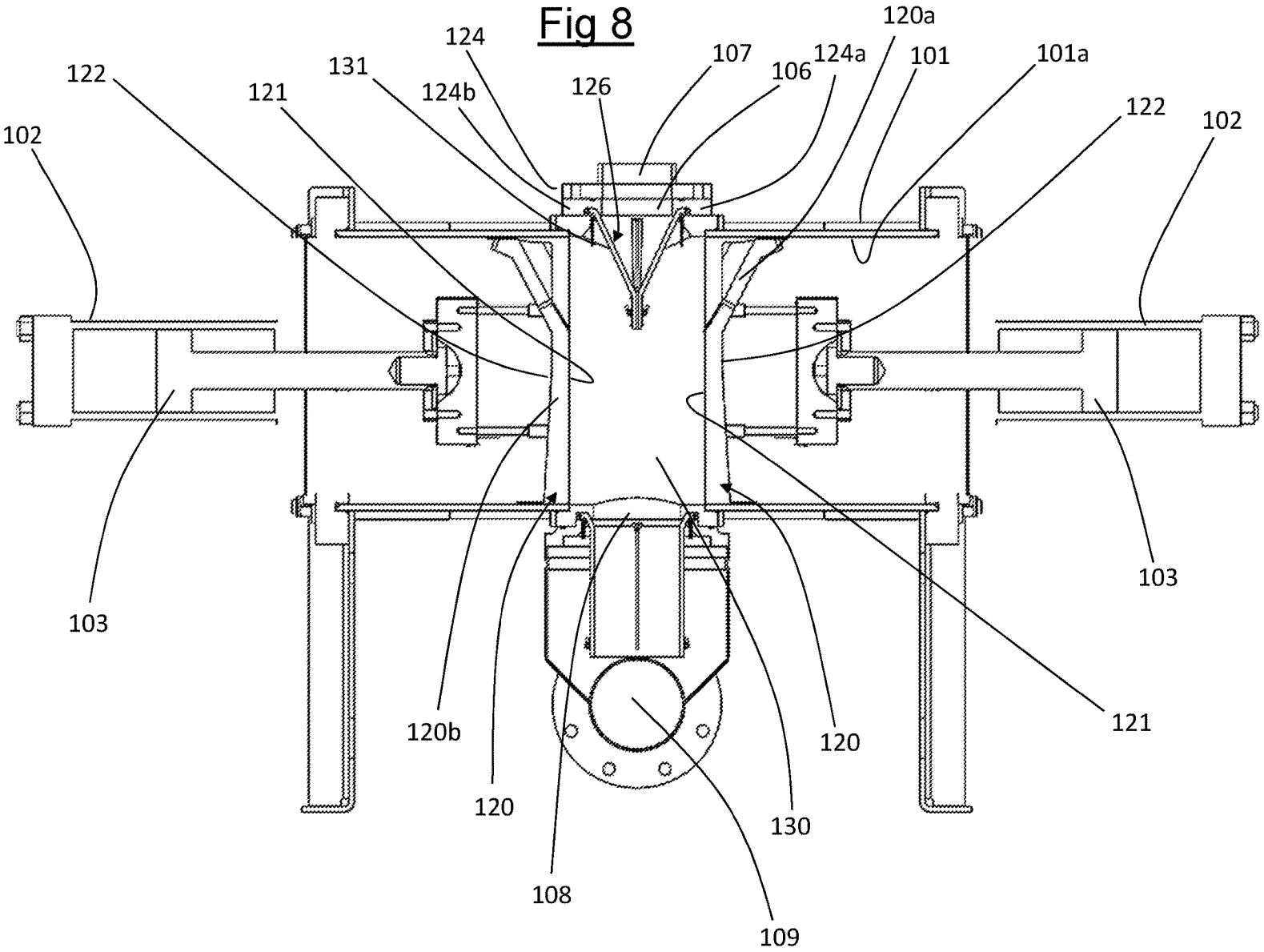
FIG. 8 is a section view along the plane VIII-VIII of the positive displacement pump of FIG. 7, with some parts removed to better highlight others, in a first operative configuration.
Figure 9:
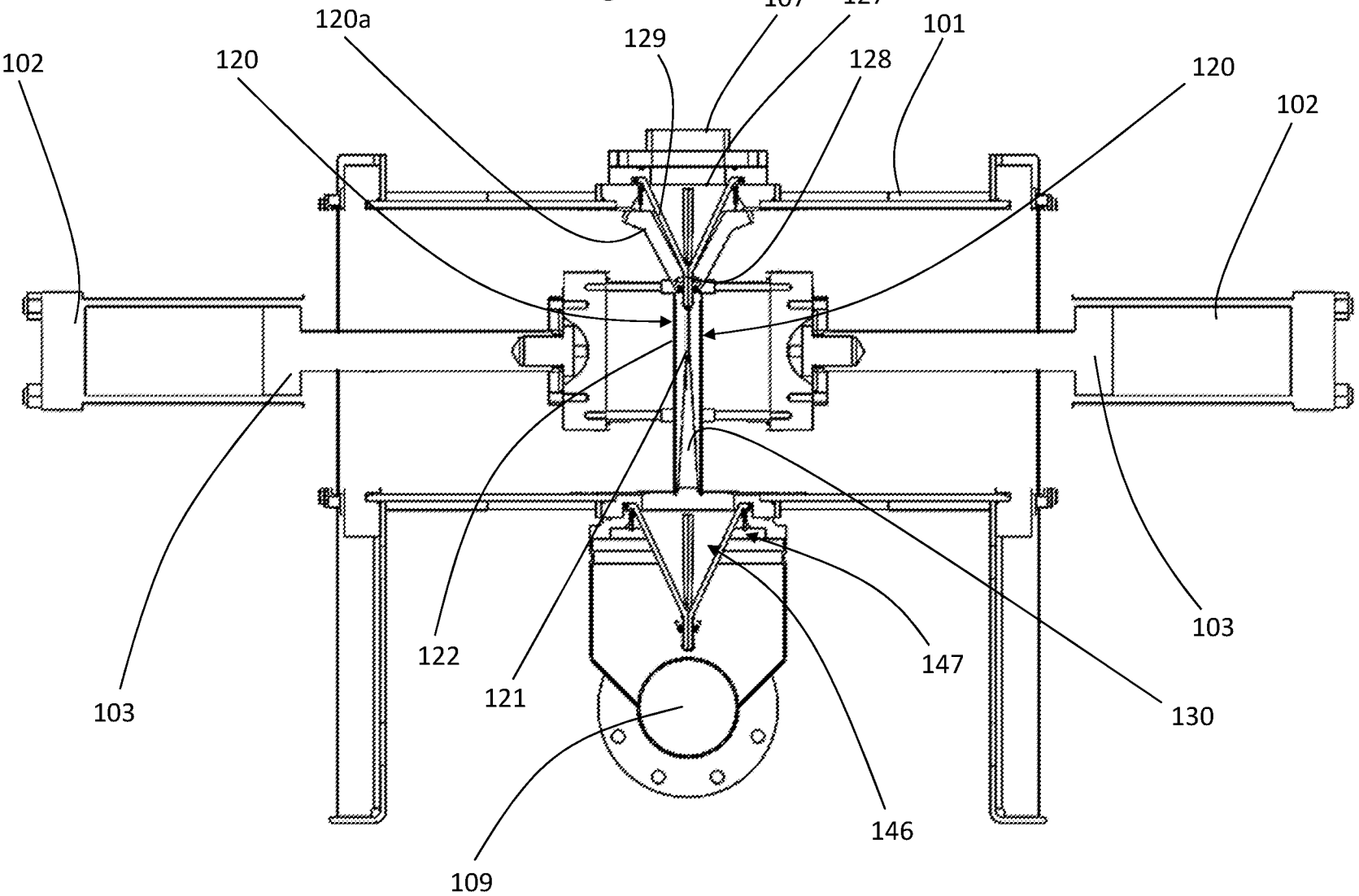
FIG. 9 is a section view along the plane VIII-VIII of the positive displacement pump of FIG. 7, with some parts removed to better highlight others, in a second operative configuration.

FIGS. 7, 8 and 9 illustrate a second embodiment of the positive displacement pump 10.

The positive displacement pump 10 comprises a pump body 101 in which two opposite actuators 102 of the electromechanical, hydraulic or pneumatic type act. Each actuator 102 comprises a piston 103 (FIG. 8) that acts inside the pump body 101.

The pump body preferably has a cylindrical shape and the actuators are arranged at the bases of the cylinder.

At a middle region of the pump body 101 and on the side surface thereof, the pump body 101 is placed in fluid communication, at an inlet end 106, with an intake duct 107 and, at an outlet end 108, with a delivery duct 109.

The inlet end 106 is diametrically opposite the outlet end 108.

As better illustrated in FIG. 8, two membranes 120 made of rigid material are inserted in the pump body 101.

The two membranes 120 are opposite one another and connected to a respective actuator 102, in particular to a respective piston 103 of the actuator.

The two membranes 120 move actuated by the respective actuator 102 towards and away from each other.

The two membranes 120 extend, inside the pump body 101, in a direction substantially transversal to the direction that separates the inlet end 106 from the outlet end 108, in other words substantially parallel to the bases of the cylindrical shape of the pump body 101.

The shape of each membrane 120 is substantially circular and has an inner wall 121 facing the inner wall 121 of the other membrane 120 and an outer wall 122 facing the respective actuator 102.

Each membrane 120 is able to slide inside the pump body 101 making a fluid-tight seal against the inner wall 101*a* thereof.

Each membrane 120 is preferably made of rigid material, in other words of a material adapted for not deforming when actuated by the respective actuators 102.

In particular, the two membranes are mobile between a retracted configuration, in which they are close-together, and an expanded configuration, in which they are separated from one another.

The two membranes 120 enclose and define a pumping chamber 130.

In particular, the pumping chamber 130 is defined between the two inner walls 121 of the membranes 120.

The pump body 101 comprises, at the inlet end 106, an annular connection flange 124 with the intake duct 107.

The annular flange 124 comprises a first half-part 124*a* and a second half-part 124*b* facing and connected to one another.

The first half-part 124*a* is fixedly connected to the pump body 101 and the second half-part 124*b* is fixedly connected to the intake duct 107.

The flange 124 has a central through opening inside which a one-way intake valve 126 is inserted and connected.

The intake valve 126 comprises an intake mouth 127, an outlet mouth 128 and a valve wall 129 that joins the intake mouth 127 to the outlet mouth 128 (FIG. 9).

The intake valve 126 is a duckbill valve, in other words it comprises an intake mouth 127 having an undeformable cylindrical shape and an outlet mouth 128 that deforms passing from the closed configuration to the open configuration.

The outlet mouth 128, when in the closed configuration, has a substantially one-dimensional shape, in other words it is defined by a (closed) linear slit and, when in the open configuration, assumes a circular shape.

The valve wall 129 joins the intake mouth 127 and the outlet mouth 128 deforming to allow the outlet mouth 128 to change shape in passing from the closed configuration to the open one.

The valve wall 129 therefore changes shape in passing from the closed configuration to the open configuration (and vice-versa) of the intake valve 126.

When the pressure downstream of the intake valve 126 is greater than that upstream, a distributed force is exerted on the valve wall 129 that deforms it making the outlet mouth 128 assume the configuration of a (closed) linear slit, closing the intake valve 126.

When the pressure downstream of the intake valve 126 is less than that upstream, a distributed force is exerted on the valve wall 129 that deforms it making the outlet mouth 128 assume the circular configuration, opening the intake valve 126.

As illustrated in FIG. 8, the intake valve 126 is at least partially, preferably completely, inserted inside the pump body 101, more in particular inside the pumping chamber 130. The valve wall 129 of the intake valve 126 is at least partially inserted, preferably completely inserted, in the pumping chamber 130.

As schematically illustrated in FIG. 9, when the membranes 120 are in the retracted configuration, the respective inner walls 121 of the membranes 120 are in contact with the valve wall 129, in other words they rest on the valve wall 129 matching the shape thereof.

For this purpose, each membrane 120 comprises an end portion 120*a* counter-shaped to the valve wall 129 when the intake valve 126 is closed.

The end portion 120*a* of each membrane 120 is arranged close to the inner wall 101*a* of the pump body, as illustrated in FIG. 9.

The end portion 120*a* of each membrane 120 is joined to a substantially flat main portion 120*b* of the membrane 120.

It should be noted that the end portion 120*a* involves only the portion of membrane 120 the bulk of which interferes with the intake valve 126. In other words, only the portion of membrane 120 intercepted by the projection of the bulk of the intake valve 126 is counter-shaped to the valve wall 129.

The volume between the membranes 120 and the valve wall 129 thus tends to be zero when the membranes 120 are in the retracted configuration.

When the membranes 120 are in the expanded configuration (as illustrated in FIG. 8), the inner wall 121 of each membrane is spaced from the valve wall 129, allowing perfect opening thereof.

A first clamping device 131 identical to the first clamping device 31 described in reference to the first embodiment is active on the outlet mouth 128 of the intake valve 126.

The first clamping device 131 is arranged between the inner surface 121 of the membranes 120 and the valve wall 129 of the intake valve 126.

At the outlet end 108 of the pump body 101 there is a delivery valve 146.

The delivery valve 146 is preferably arranged outside of the pump body 101 and inside the delivery duct 109, as illustrated in FIGS. 8 and 9.

The delivery valve 146 is structurally identical to the intake valve 126.

A second clamping device 147 which has the function of ensuring perfect closure of the delivery valve and also of triggering the closure thereof is active on the delivery valve 146.

The second clamping device 147 is preferably identical to the first clamping device 131.

When the positive displacement pump starts, the membranes 120 are in the retracted configuration (FIG. 9).

In this configuration, the intake valve 126 is closed since a force acts on the valve wall 129 thereof that is generated by the pressure difference between the intake duct 107 and the pumping chamber 130. In this condition, in the intake duct 107 the pressure is greater than that in the pumping chamber 130.

The membranes 120 contact, through the end portion 120*a*, the valve surface 129 so that the dead volume between the membranes 120 and intake valve 126 is zero or in any case very low.

In this configuration, the pressing members of the first clamping device 131 assist the valve surface 129 in keeping the outlet mouth 128 of the intake valve 126 in closed position.

The delivery valve 146 is also closed, since the pressure inside the pumping chamber 130 is substantially equal to the pressure in the delivery duct 109 and the membrane 120 is in retracted configuration.

Moreover, the pressing members of the second clamping device 147 assist the valve surface in keeping the outlet mouth of the delivery valve 146 in closed position.

In this condition, the total volume of the pumping chamber 130 (which defines the dead volume) is very low, since the two membranes 120 are in substantial contact and in contact with the valve wall 129 of the intake valve 126. The dead volume is substantially given by the inner volume of the delivery valve 146.

When the two membranes 120 move apart, the volume of the pumping chamber 130 expands, decreasing the pressure inside the pumping chamber 130.

The pressure decrease inside the pumping chamber 130 is inversely proportional to the dead volume of the pumping chamber itself (the lower the dead volume, the greater the pressure decrease), and therefore, since such a dead volume is very low (due to what has been stated above), the pressure decrease inside the pumping chamber 130 is substantial.

This makes it possible to obtain an excellent head of the positive displacement pump 10, in other words an ability to draw liquid from lower heights close to the maximum lower height theoretically reachable.

The pressure decrease inside the pumping chamber 130 determines the opening of the intake valve 126.

The pressing members of the first clamping device 131 move apart under the thrust of the valve wall 129 of the intake valve 126 allowing the complete opening of the intake valve 126.

The delivery valve 146 is still closed since the pressure inside the pumping chamber 130 is less than the pressure in the delivery duct 109.

The depression (pressure decrease) inside the pumping chamber 130 draws fluid from the intake duct 107 and the intake valve 126 allows the passage of muddy liquids and even liquids containing solids towards the pumping chamber 130.

When the pumping chamber 130 is completely expanded, it is filled with liquid drawn from the intake duct 107.

The membranes 120 start to move closer together under the effect of the respective actuators 102.

At this point the intake valve 126 starts to close since the pressure inside the pumping chamber 130 starts to increase.

The pressing members of the first clamping device 131 act on the valve surface 129 tending to close the outlet mouth 128 of the intake valve 126.

In a few moments the intake valve 126 (given its duckbill shape) closes completely.

At the same time, the delivery valve 146 opens, since the liquid contained in the pumping chamber 130, under the effect of the thrust of the membranes 120, floods the delivery valve 146.

This configuration is shown in FIG. 8.

The liquid drawn is then sent in the delivery duct 109 until the membranes 120 reach the retracted configuration again, in which the delivery valve 146 also closes.

The cycle described above starts again and repeats as long as the actuators 102 are in operation.

Figure 10:
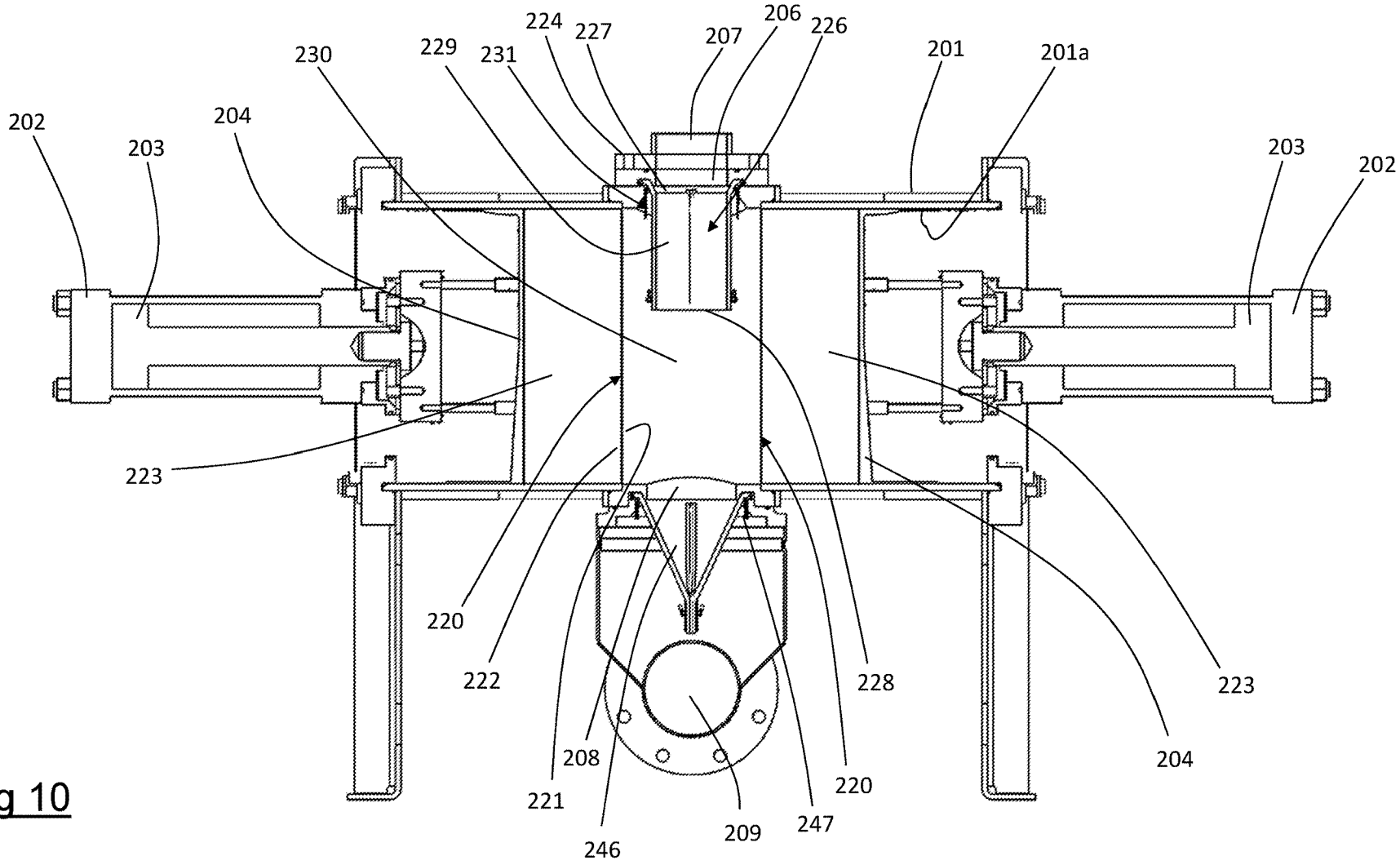
FIG. 10 is a section view along the plane VIII-VIII of a variant embodiment of the positive displacement pump of FIG. 7, with some parts removed to better highlight others, in a first operative configuration.

FIG. 10 illustrates a third embodiment of the positive displacement pump 10.

The positive displacement pump 10 comprises a pump body 201 in which two opposite actuators 202 of the electromechanical, hydraulic or pneumatic type act. Each actuator 202 comprises a piston 203 that acts inside the pump body 201.

The pump body preferably has a cylindrical shape and the actuators are arranged at the bases of the cylinder.

At a middle region of the pump body 201 and on the side surface thereof, the pump body 201 is placed in fluid communication, at an inlet end 206, with an intake duct 207 and, at an outlet end 208, with a delivery duct 209.

The inlet end 206 is diametrically opposite the outlet end 208.

Two membranes 220 made of flexible material, like for example natural rubber, are inserted in the pump body 201.

The two membranes 220 are opposite one another and connected in a fluid-tight manner to the inlet end 106 and to the outlet end 208 of the pump body 201 so that a pumping chamber 230 is made between an inner wall 221 of each membrane and the pump body 201.

A work volume 223 is defined between the outer walls 222 of the membranes 220 and the respective actuator 202.

Concerning this, each actuator 202 comprises a plate 204 facing the respective membrane 220 and contained inside the pump body 201. Each plate 204 is connected to the respective piston 203 of the actuator 202 to move from and towards the membrane 220.

The work volume 223 is filled with a work fluid like for example oil or water.

When an actuator 202 is actuated towards the respective membrane 220, the work liquid exerts a pressure on the membrane 220 that causes the contraction of the latter in a retracted configuration.

The pressure exerted by the work fluid on each membrane 220 is substantially evenly distributed along the entire outer wall 222 of each membrane 220.

When an actuator 202 is actuated away from the respective membrane 220, the membrane 220 expands.

The pump body 201 comprises, at the inlet end 206, an annular connection flange 224 with the intake duct 207.

The annular flange 224 comprises a first half-part and a second half-part facing and connected to one another.

The first half-part is fixedly connected to the pump body 201 and the second half-part is fixedly connected to the intake duct 207.

Between the first and the second half-part of the flange 224 it is possible to form a substantially annular housing seat in which a free edge of each membrane 220 is housed.

The flange 224 has a central through opening inside which a one-way intake valve 226 is inserted and connected.

The intake valve 226 comprises an intake mouth 227, an outlet mouth 228 and a valve wall 229 that joins the intake mouth 227 to the outlet mouth 228.

The intake valve 226 is a duckbill valve, in other words it comprises an intake mouth 227 having an undeformable cylindrical shape and an outlet mouth 228 that deforms passing from the closed configuration to the open configuration.

The outlet mouth 228, when in the closed configuration, has a substantially one-dimensional shape, in other words it is defined by a (closed) linear slit and, when in the open configuration, assumes a circular shape.

The valve wall 229 joins the intake mouth 227 and the outlet mouth 228 deforming the allow the outlet mouth 228 to change shape in passing from the closed configuration to the open one.

The valve wall 229 therefore changes shape in passing from the closed configuration to the open one (and vice-versa) of the intake valve 226.

The intake valve 226 is at least partially, preferably completely, inserted in the pumping chamber 230. The valve wall 229 of the intake valve 226 is at least partially inserted, preferably completely inserted, in the pumping chamber 230. In particular, the valve wall 229 of the intake valve 226 is at least partially inserted, preferably completely inserted, between the two membranes 220.

As can be appreciated from FIG. 10, the intake valve 226 is inserted between the two membranes 220.

When the membranes 220 are in the retracted configuration, the inner wall 221 of the membrane is in close contact with the valve wall 229, in other words it rests on the valve wall 229 matching the shape thereof.

The volume between the membrane 220 and the valve wall 229 tends to be zero when the membrane 220 is in the retracted configuration.

When the membrane 220 is in the expanded configuration (as illustrated in FIG. 10), the inner wall 221 of the membrane is spaced from the valve wall 229, allowing perfect opening thereof.

A first clamping device 231 identical to the first clamping device 31 and to the first clamping device 131 described in reference to the first and second embodiment is active on the outlet mouth 228 of the intake valve 226.

The first clamping device 231 is arranged between the inner surface 221 of the membranes 220 and the valve wall 229 of the intake valve 226.

At the outlet end 208 of the pump body 201 there is a delivery valve 246.

The delivery valve 246 is preferably arranged outside of the pump body 201 and inside the delivery duct 209, as illustrated in FIG. 10.

The delivery valve 246 is structurally identical to the intake valve 226.

A second clamping device 247 which has the function of ensuring perfect closure of the delivery valve and also of triggering the closure thereof is active on the delivery valve 246.

The second clamping device 247 is preferably identical to the first clamping device 231.

When the positive displacement pump starts, the membranes 220 are in the retracted configuration.

In this configuration, the intake valve 226 is closed since a force acts on the valve wall 229 thereof that is generated by the pressure difference between the intake duct 207 and the pumping chamber 230. In this condition, in the intake duct 207 the pressure is greater than that in the pumping chamber 230.

The membranes 220 contact the valve surface 229 so that the dead volume between the membranes 220 and intake valve 226 is zero or in any case very low.

In this configuration, the pressing members of the first clamping device 231 assist the valve surface 229 in keeping the outlet mouth 228 of the intake valve 226 in closed position.

The delivery valve 246 is also closed, since the pressure inside the pumping chamber 230 is substantially equal to the pressure in the delivery duct 209 and the membrane 220 is in retracted configuration.

Moreover, the pressing members of the second clamping device 247 assist the valve surface in keeping the outlet mouth of the delivery valve 246 in closed position.

In this condition, the total volume of the pumping chamber 230 (which defined the dead volume) is very low, since the two membranes 220 are in substantial contact and in contact with the valve wall 229 of the intake valve 226. The dead volume is substantially given by the inner volume of the delivery valve 246.

When the two membranes 220 move apart (due to the movement of the plates 204 away from the respective membranes 220), the volume of the pumping chamber 230 expands decreasing the pressure inside the pumping chamber 230.

The pressure decrease inside the pumping chamber 230 is inversely proportional to the dead volume of the pumping chamber itself (the lower the dead volume, the greater the pressure decrease), and therefore, since such a dead volume is very limited (due to what was stated above), the pressure decrease inside the pumping chamber 230 is substantial.

This makes it possible to obtain an excellent head of the positive displacement pump 10, in other words an ability to draw liquid from lower heights close to the maximum lower height theoretically reachable.

The pressure decrease inside the pumping chamber 230 determines the opening of the intake valve 226.

The pressing members of the first clamping device 231 move apart under the thrust of the valve wall 229 of the intake valve 226 allowing the complete opening of the intake valve 226.

The delivery valve 246 is still closed since the pressure inside the pumping chamber 230 is less than the pressure in the delivery duct 209.

This configuration is shown in FIG. 10.

The depression (pressure decrease) inside the pumping chamber 230 draws fluid from the intake duct 207 and the intake valve 226 allows the passage of muddy liquids and even liquids containing solids towards the pumping chamber 230.

When the pumping chamber 230 is completely expanded, it is filled with liquid sucked from the intake duct 207.

The membranes 220 start to move together under the effect of the movement together of the plates 204.

At this point the intake valve 226 starts to close since the pressure inside the pumping chamber 230 starts to increase.

The pressing members of the first clamping device 231 act on the valve surface 229 tending to close the outlet mouth 228 of the intake valve 226.

In a few moments the intake valve 226 (given its duckbill shape) closes completely.

At the same time, the delivery valve 246 opens, since the liquid contained in the pumping chamber 230, under the effect of the thrust of the membranes 220, floods the delivery valve 246.

The liquid sucked is then sent in the delivery duct 209 until the membranes 220 reach the retracted configuration again, in which the delivery valve 246 also closes.

The cycle described above starts again and repeats so long as the actuators 202 are in operation.

Of course, those skilled in the art, in order to satisfy specific and contingent requirements, can bring numerous modifications and variants to the positive displacement pump of the present invention, all of which are in any case encompassed by the scope of protection defined by the following claims.

The invention claimed is:

1. A positive displacement pump comprising: —a pump body comprising an inlet end and an outlet end; —a pumping chamber arranged between said inlet end and said outlet end; —at least one membrane at least partially defining the pumping chamber and mobile between an expanded configuration in which a volume of the pumping chamber is maximum and a retracted configuration in which the volume of the pumping chamber is minimum; —a delivery valve arranged close to the outlet end of the pump body; —an intake valve comprising an intake mouth, an outlet mouth defining a top end of the intake valve, and a valve wall that joins the intake mouth to the outlet mouth, the intake mouth being coupled to the inlet end of the pump body and the outlet mouth being inserted in the pumping chamber, wherein said at least one membrane, when in the retracted configuration, adheres to and contacts the valve wall, and a profile of the at least one membrane follows an entire profile of the valve wall of the intake valve and the outlet mouth is closed, wherein when said at least one membrane is in the expanded configuration, the outlet mouth of the intake valve is open and the at least one membrane does not contact the intake valve.

2. A positive displacement pump comprising:

a pump body comprising an inlet end and an outlet end;

a pumping chamber arranged between said inlet end and said outlet end;

at least one membrane at least partially defining the pumping chamber and mobile between an expanded configuration in which a volume of the pumping chamber is maximum and a retracted configuration in which the volume of the pumping chamber is minimum;

a delivery valve arranged close to the outlet end of the pump body;

an intake valve comprising an intake mouth, an outlet mouth and a valve wall that joins the intake mouth to the outlet mouth, the intake mouth being coupled to the inlet end of the pump body and the outlet mouth being inserted in the pumping chamber, wherein said at least one membrane, when in the retracted configuration, adheres to the valve wall of the intake valve and the outlet mouth is closed; and wherein when the at least one membrane is in the expanded configuration, the outlet mouth of the intake valve is open and the at least one membrane does not contact the intake valve.

3. The positive displacement pump according to claim 2, further comprising a first clamping device active on the outlet mouth of the intake valve and inserted in said pumping chamber to close said outlet mouth so that the outlet mouth is fluid-tight when the at least one membrane is in the retracted configuration.

4. The positive displacement pump according to claim 3, wherein said first clamping device comprises a pair of opposite pressing members active at the outlet mouth of the intake valve, said pressing members being rotatably and elastically coupled to the inlet end of the pump body to move between a close together position in which the pair of opposite pressing members close the outlet mouth of the intake valve and a separated condition in which the pair of opposite pressing members leave the outlet mouth of the intake valve open.

5. The positive displacement pump according to claim 2, wherein said at least one membrane is a substantially tubular membrane, an internal volume of said substantially tubular membrane defines the pumping chamber, said substantially tubular membrane is coupled to the inlet end and to the outlet end of the pump body and deformable between the expanded configuration and the retracted configuration.

6. The positive displacement pump according to claim 2, wherein said at least one membrane comprises a connection appendage having a first edge that extends from an outer surface of the at least one membrane and a second free edge coupled in a fluid-tight manner to the outlet end of the pump body.

7. The positive displacement pump according to claim 6, wherein said delivery valve is defined by a free end portion of the at least one membrane extending beyond the first edge of the connection appendage towards the outlet end of the pump body.

8. The positive displacement pump according to claim 5, wherein said pump body comprises a work opening in fluid communication with a work fluid source and wherein the internal volume of said substantially tubular membrane is isolated from a work fluid; a work volume being defined between said substantially tubular membrane and said pump body, said work volume being configured to be filled with and at least partially emptied of said work fluid.

9. The positive displacement pump according to claim 2, wherein said at least one membrane further comprises two opposite rigid membranes defining said pumping chamber, each of said two opposite rid membranes comprising an end portion counter-shaped to a shape of the valve wall of the intake valve when the outlet mouth of the intake valve is closed.

10. The positive displacement pump according to claim 9, wherein each of said two opposite rid membranes is configured to move between the expanded configuration and the retracted configuration by electromechanical, hydraulic or pneumatic actuator members.

11. The positive displacement pump according to claim 2, wherein said at least one membrane further comprises two opposite flexible membranes defining said pumping chamber, each of said two opposite flexible membranes being coupled to the inlet end and to the outlet end of the pump body and being deformable between the expanded configuration and the retracted configuration.

12. The positive displacement pump according to claim 11, comprising a pair of work chambers containing a work fluid isolated from the pumping chamber by said two opposite flexible membranes, actuator members being active on said work fluid to transmit a pressure to said two opposite flexible membranes and switch them from the retracted configuration to the expanded configuration and vice-versa.

13. The positive displacement pump according to claim 2, wherein a pressure exerted on said at least one membrane when in the retracted configuration is substantially evenly distributed against the at least one membrane.

* * * * *